US010129970B2

(12) United States Patent
Merrill et al.

(10) Patent No.: US 10,129,970 B2
(45) Date of Patent: Nov. 13, 2018

(54) SMOOTH RADIUS NOZZLE FOR USE IN A PLASMA CUTTING DEVICE

(71) Applicant: American Torch Tip Company, Bradenton, FL (US)

(72) Inventors: Matthew Joel Merrill, Bradenton, FL (US); Jeffery Kenneth Walters, Sarasota, FL (US)

(73) Assignee: American Torch Tip, Co., Bradenton, FL (US)

( * ) Notice: Subject to any disclaimer, the term of this patent is extended or adjusted under 35 U.S.C. 154(b) by 141 days.

(21) Appl. No.: 14/446,740

(22) Filed: Jul. 30, 2014

(65) Prior Publication Data

US 2016/0037618 A1 Feb. 4, 2016

(51) Int. Cl.
*H05H 1/34* (2006.01)

(52) U.S. Cl.
CPC ..... *H05H 1/34* (2013.01); *H05H 2001/3478* (2013.01); *H05H 2001/3484* (2013.01)

(58) Field of Classification Search
CPC ..... H05H 1/34
USPC ..... 219/121.48, 121.49, 121.5, 121.51, 219/121.52
See application file for complete search history.

(56) References Cited

U.S. PATENT DOCUMENTS 4,300,723 A * 11/1981 Prasthofer ..... B05B 15/065 239/499
5,573,682 A * 11/1996 Beason, Jr. ..... H05H 1/34 219/121.47
5,591,356 A * 1/1997 Sakuragi ..... H05H 1/34 219/121.48
5,736,708 A 4/1998 Delzenne
5,747,767 A * 5/1998 Severance ..... H05H 1/28 219/121.48
5,977,510 A 11/1999 Lindsay
6,020,572 A 2/2000 Marner
6,268,583 B1 * 7/2001 Yamaguchi ..... B23K 10/00 219/121.49
7,605,340 B2 10/2009 Duan
7,608,797 B2 * 10/2009 Belashchenko ..... B05B 7/205 219/121.36
7,829,816 B2 11/2010 Duan
8,338,740 B2 12/2012 Liebold
2006/0289398 A1 * 12/2006 Cook ..... B23K 10/00 219/121.5

* cited by examiner

*Primary Examiner* — Ibrahime A Abraham
*Assistant Examiner* — Justin Dodson
(74) *Attorney, Agent, or Firm* — Mark Rubio

(57) ABSTRACT

A nozzle for use with a plasma arc torch is provided. The nozzle has a nozzle body having a length that extends from a proximal end to a distal end, a central bore disposed within the nozzle body along a central axis having a feed orifice at the proximal end of the nozzle body, and a discharge orifice at the distal end of the nozzle body. The central bore has a series of internal sections that transition with one or more radial edges between the feed orifice and the discharge orifice. The series of internal sections have a first section beginning at the feed orifice transitioning to a converging section transitioning at a throat to a diverging section ending at the discharge orifice. The length of the converging section is longer than a length of the diverging section. A Venturi effect is created by the converging and diverging sections of the nozzle.

39 Claims, 5 Drawing Sheets

SMOOTH RADIUS NOZZLE FOR USE IN A PLASMA CUTTING DEVICE

RELATED APPLICATION

This application claims the benefit of the filing date of U.S. Provisional Patent Application Ser. No. 61/861,720, filed on Aug. 2, 2013, entitled "Smooth Radius Nozzle for use with a Plasma Cutting device" by Merrill et al., the entirety of which is incorporated herein by reference.

BACKGROUND OF THE INVENTION

Field of Invention

The present invention is in the technical field of plasma cutting devices. More particularly, the present invention is in the technical field of nozzles for use in plasma cutting torches.

Description of Related Art

Prior art plasma cutting devices, which include plasma torches, have been well-known for many years and are used in cutting and piercing metal work pieces. Plasma cutting devices use an anode and cathode to generate an electrical arc that ionizes a working plasma gas, usually air or oxygen. Several factors are taken into account in determining the quality of a plasma torch's ability to cut a particular metal work piece. Some of these factors include the perpendicularity or cut angle of the plasma jet over the length of the work piece; the condition of the edges of the work niece, rounded edges versus sharp edges; the amount of "dross" or spatter that is created by the cut; and the depth at which the plasma jet can maintain these characteristics. The amount of momentum that a plasma jet is able to develop is determined by the mass flow of the plasma and shielding gases, which is determined by the plasma torch's nozzle configuration. Without sufficient momentum, a plasma jet can lose the ability to penetrate a work piece without leaving dross behind or produce a perpendicular cut with sharp edges.

FIG. 1 shows an example of a plasma torch and nozzle configuration of the prior art. The plasma torch shown therein comprises an axial electrode 5 that acts as the cathode and a nozzle 1 that acts as the anode. The nozzle 1 comprises a central axial bore 12 with an exit orifice 9 at the distal end of the nozzle 1. An initial arc is created in the central axial bore 12 at an initiation point 11 that ionizes the plasma working gas. The ionized gas then becomes a plasma jet that is pushed out to the work piece (not shown) while the plasma torch 10 is in operation. The initiation arc is typically generated in the smallest gap between the nozzle 1 and electrode 5, known as the initiation point 11. The central bore 12 of the nozzle 1 also serves as a means to direct the flow of the plasma jet through the exit orifice 9 via a flow path 41 created by the inner diameter of the nozzle 1 and the outer diameter of the axial electrode 5. The configuration of the flow path 41 and exit orifice 9 will affect the flow characteristics of the plasma jet and determine the cut quality of the plasma torch 10. The nozzle 1 has a counter bore 40 adapted to receive the swirl ring 7 at the proximal end of the nozzle 1.

The nozzle configuration of the plasma torch of FIG. 1 shows the central axial bore 12 configured as a combination of cylinders and cones; these geometries allow for the central axial bore 12 to transition in size from the proximal end to the exit orifice 9 at the distal end of the nozzle 1.

Geometrically speaking, the central axial bore 12 is configured as a bore bounded by a wall, wherein the shape of the bore comprises a region bounded by a horizontal line and revolved about the central axis to form a cylinder, or a region bounded by a sloped line and revolved to form a cone. These resulting shapes are referred to a "solids of revolution." As is typical with these torches, the intersection of the various cylinder and cones that make up the central axial bore 12 comprises sharp edges or corners where the faces of the cylinders and cones meet.

To illustrate this more clearly, a partial cut-away cross sectional 2-D view of nozzle 1 is provided in FIG. 2. Therein the series of joined faces (A-F) that makes up the central axial bore 12 leading to the exit orifice 9 can be seen. Specifically, the transitions between each of these faces comprise sharp angular inner and outer corners or edges. For example, the transition between faces B and C comprises a sharp angular outer corner ∠BC followed by the transition between faces C and D forming a sharp angular inner corner ∠CD.

These sharp angular inner and outer corners or edges seen in the prior art nozzle configurations cause undesirable turbulence and recirculation zones during the operation of the plasma torch 10. These turbulence and recirculation zones can adversely affect the plasma jet's ability to penetrate a work piece or the plasma jet's ability to produce cuts of adequate quality. In an attempt by some prior art nozzle designs to solve the problem of turbulence and recirculation, a two piece nozzle that has a secondary flow path that removes the plasma gas that would normally contribute to recirculation and or turbulence is used. In the case of the two-piece nozzle seen in FIG. 7 of U.S. Pat. No. 7,605,340, the secondary flow path 372 is placed at the equivalent location of sharp angular inner corner ΦAB in FIG. 2 of the prior art nozzle 1; the turbulent flow or recirculation zone that would inherently occur at the sharp corner is purged via the secondary flow path 372. Additionally, U.S. Pat. No. 7,605,340 claims the secondary flow as a coolant.

Accordingly, there is a need in the art for a nozzle configuration that can address the undesirable turbulence and recirculation zones without the added complexities of design and manufacture from the use of a two piece design or a secondary flow path. The present invention is designed to address this need.

SUMMARY OF THE INVENTION

A nozzle for use with a plasma arc torch is provided. The nozzle has a nozzle body having a length that extends from a proximal end to a distal end, a central bore disposed within the nozzle body along a central axis having a feed orifice at the proximal end of the nozzle body, and a discharge orifice at the distal end of the nozzle body. The central bore has a series of internal sections that transition with one or more radial intersections between the feed orifice and the discharge orifice. The series of internal sections have a first section beginning at the feed orifice, transitioning to a converging section transitioning at a throat to a diverging section ending at the discharge orifice. The length of the converging section is longer than a length of the diverging section. A Venturi effect is created by the converging and diverging sections of the nozzle.

BRIEF DESCRIPTION OF THE DRAWINGS

Figures are not drawn to scale.

DETAILED DESCRIPTION OF THE INVENTION

Figure 1:
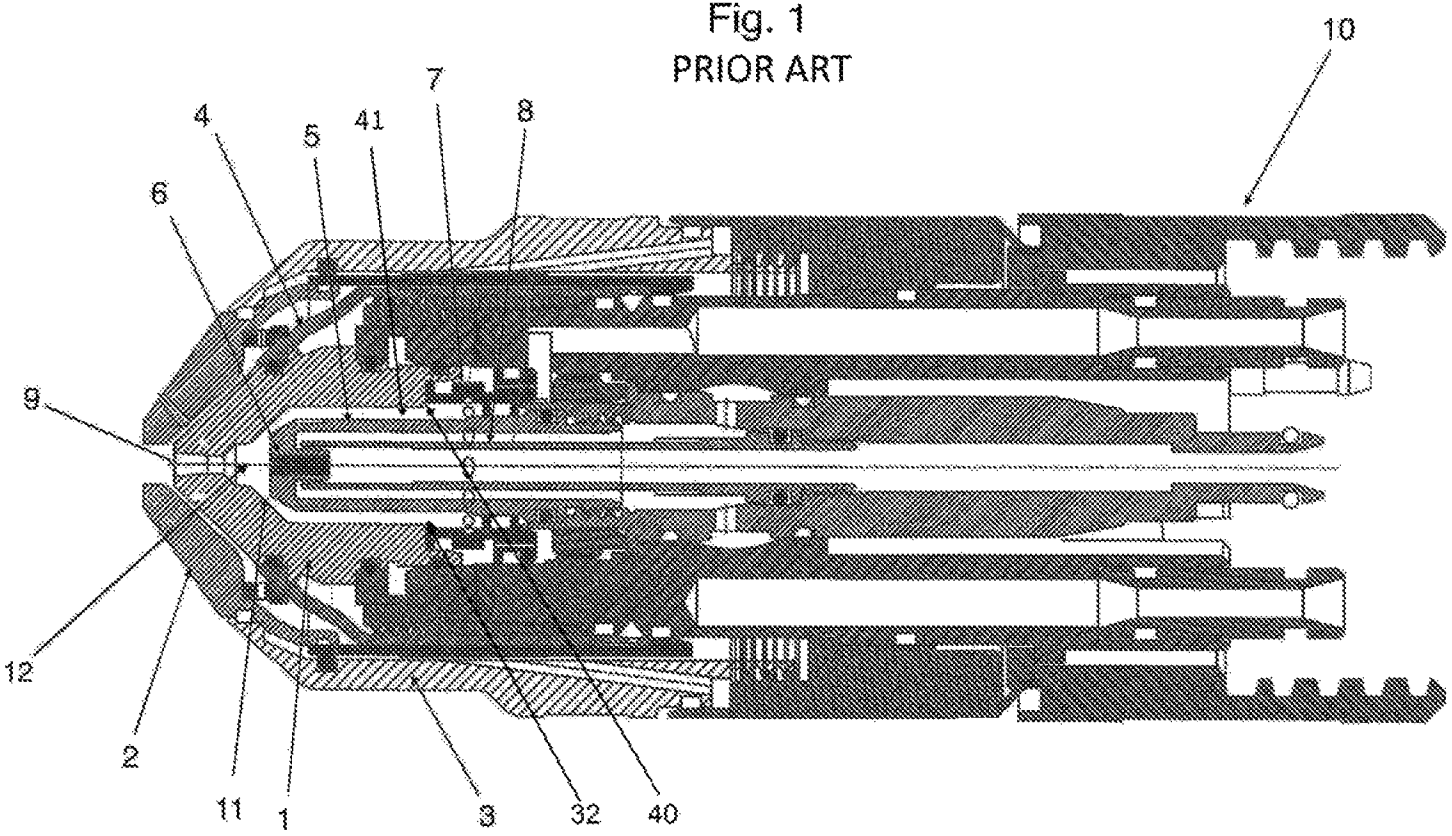
Fig. 1 PRIOR ART
FIG. 1 is a cross section of a prior art plasma torch assembly.
Figure 2:
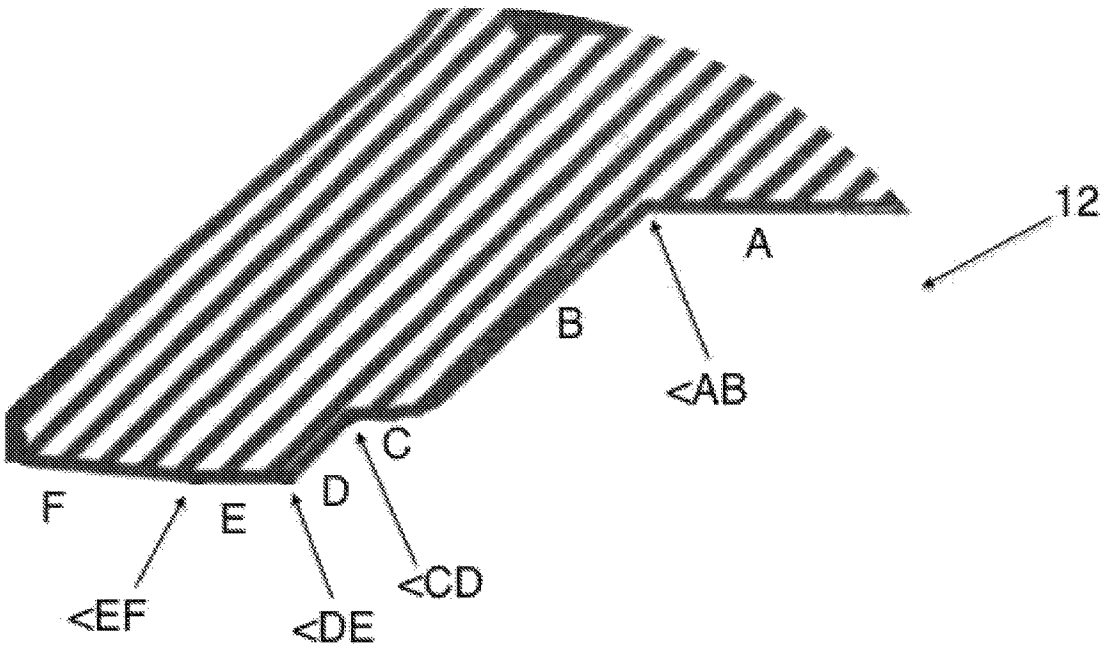
Fig. 2 PRIOR ART
FIG. 2 is a partial cross section detailing the central axial bore and exit orifice of a prior art plasma torch nozzle.

Referring now to the drawings, wherein like reference numerals designate identical or corresponding parts throughout the several views, embodiments of the invention shown. The present invention is a plasma torch nozzle having a configuration adapted to address the undesirable turbulence and recirculation zones.

Figure 3:
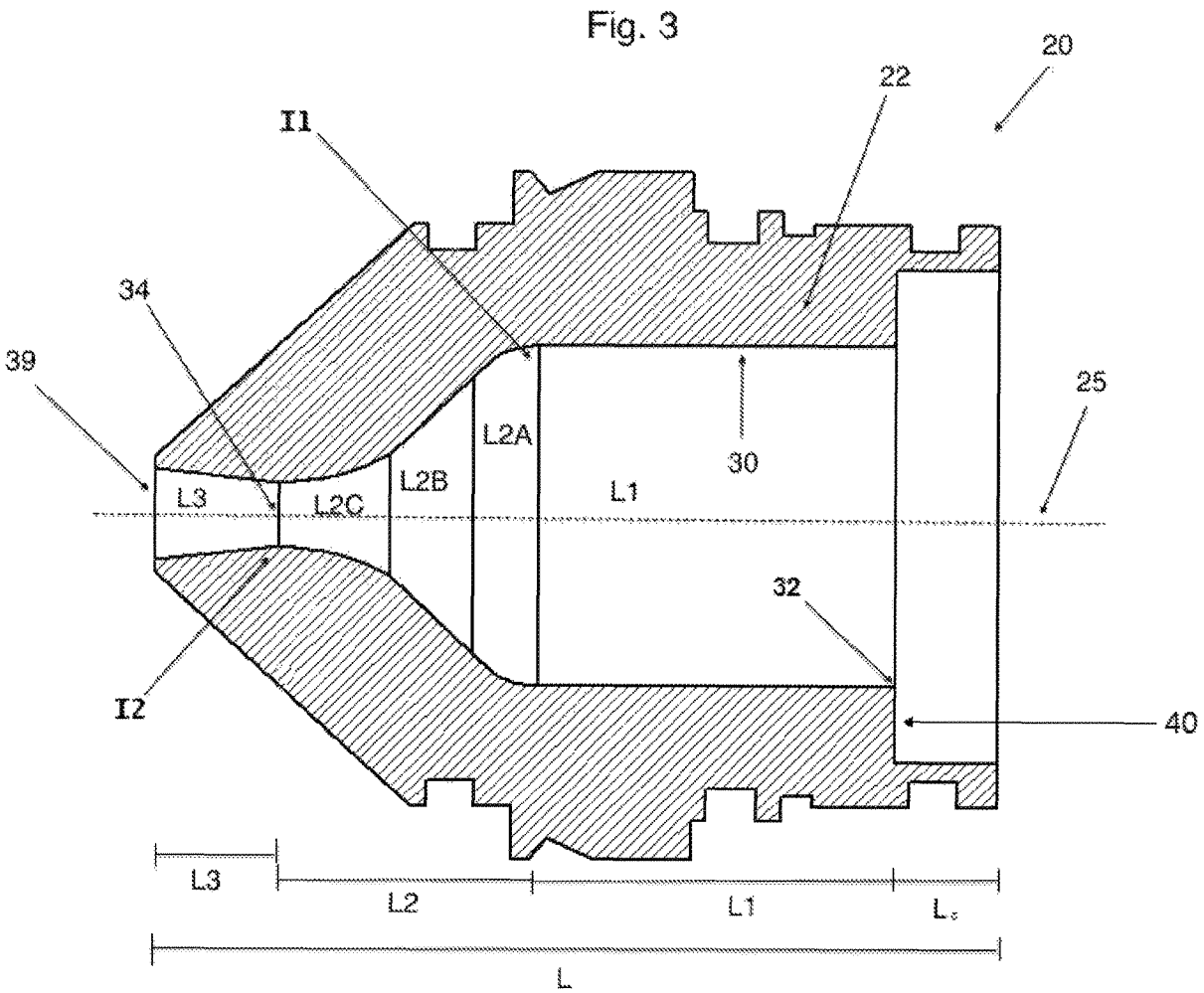
FIG. 3 is a cross section of one embodiment illustrating aspects of the present invention.
Figure 4:
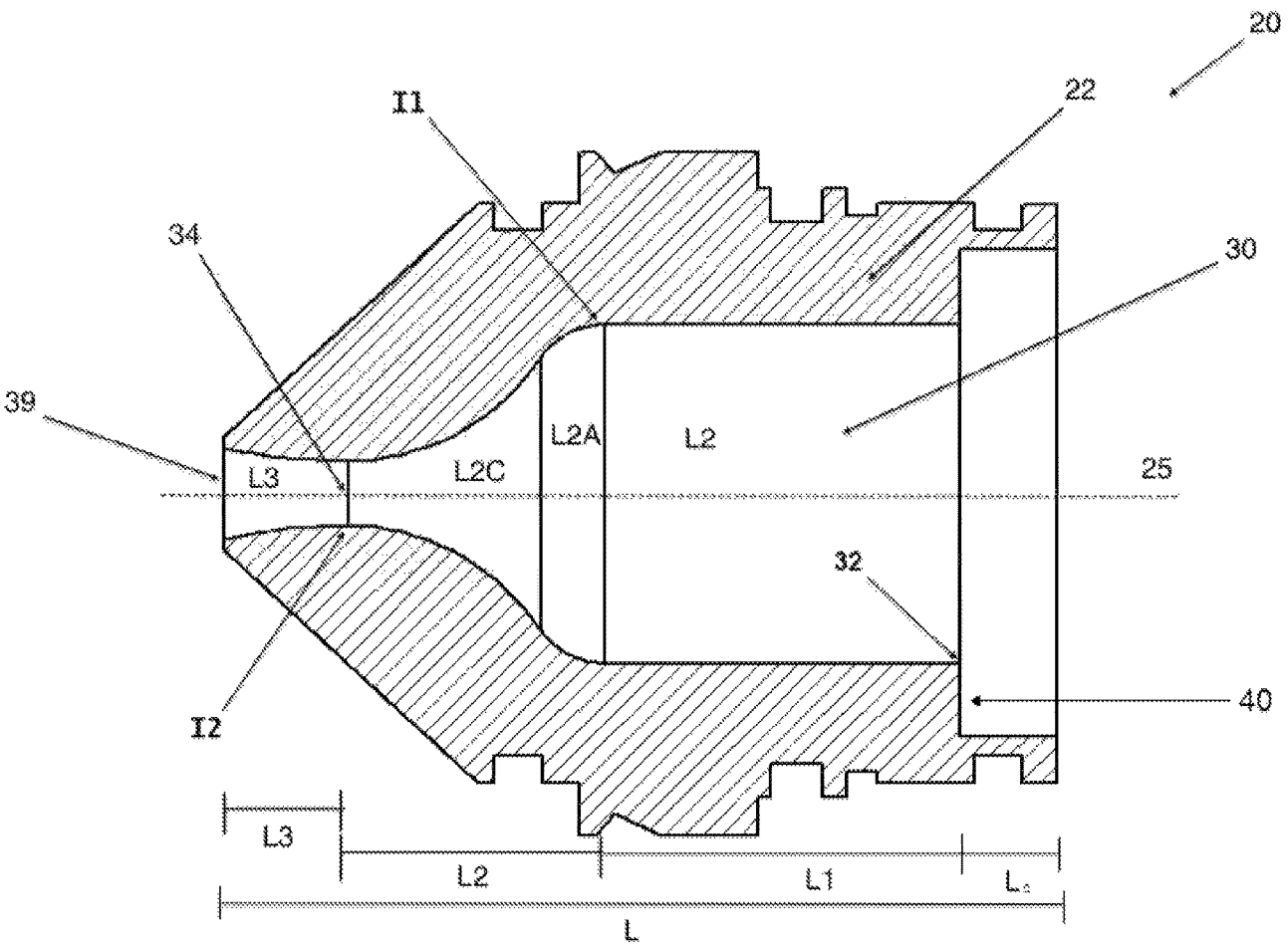
FIG. 4 is a cross section of a second embodiment illustrating aspects of the present invention.
Figure 5:
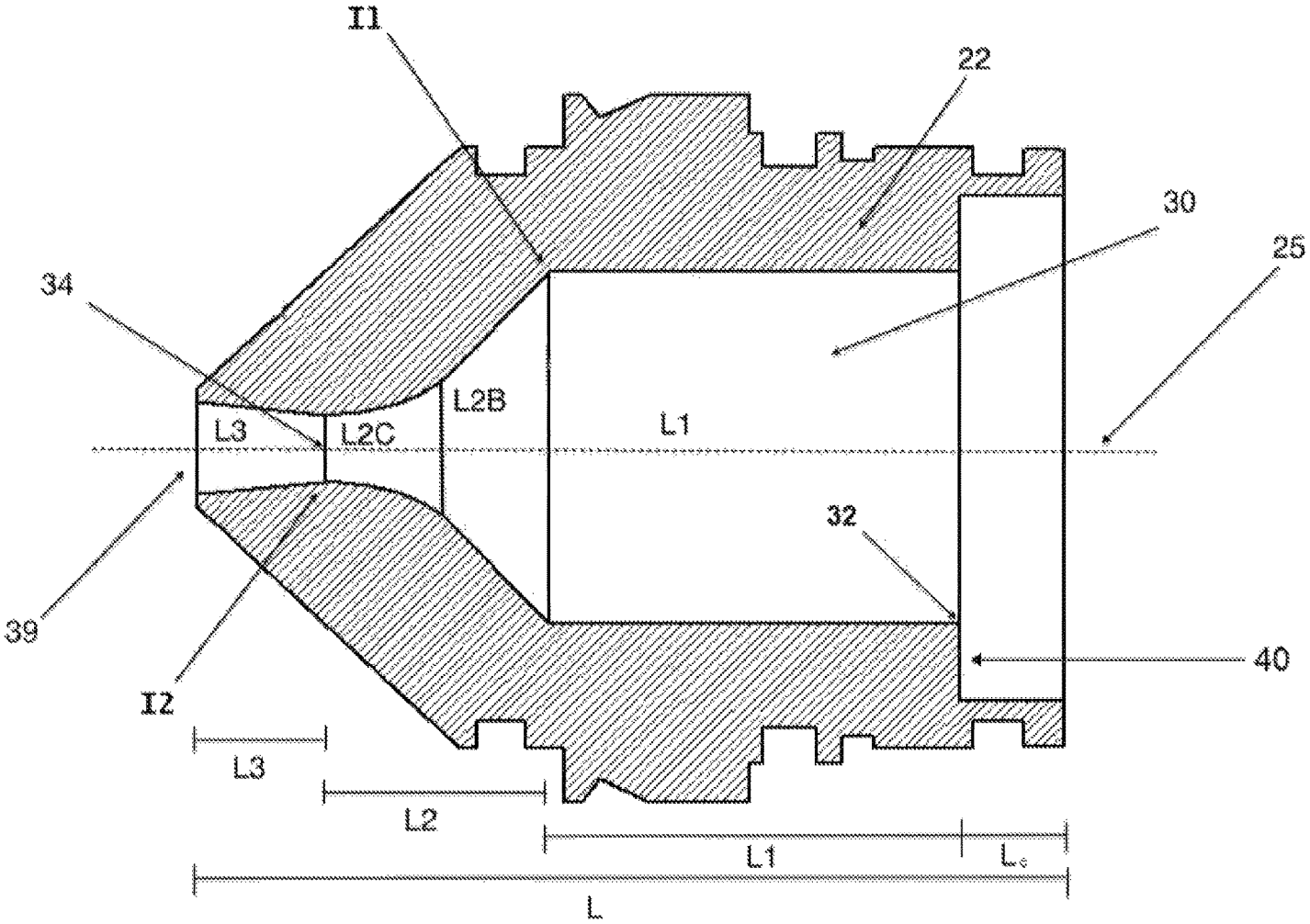
FIG. 5 is a cross section of a third embodiment illustrating aspects of the present invention.

Generally speaking, as illustrated in FIGS. 3-5, the nozzle 20 is adapted for use with a plasma arc torch (not shown), and includes a nozzle body 22 having a length L that extends from a proximal end to a distal end and a central bore 30 disposed within the nozzle body 22 along a central axis 25. The central bore 30 has a feed orifice 32 at the proximal end of the nozzle body 22 and a discharge orifice 39 at the distal end of the nozzle body 22. The nozzle 20 is manufactured from one piece of material and only has one flow path defined by the central bone 30.

The central bore 30 comprises a counter bore section Lc and a series of internal sections $L_1$, $L_2$, $L_3$ that transition with one or more radial intersections between the plasma gas feed orifice 32 and the plasma gas discharge orifice 39 along its length L. The radial intersections generally exhibit geometric continuity between the faces of the internal sections $L_1$, $L_2$, $L_3$ This geometric continuity provides for smooth transitions. The series of successive internal sections comprise a first section $L_1$ beginning at or around the feed orifice 32, transitioning to a converging section $L_2$ wherein the cross-sectional area decreases, transitioning to a diverging section $L_3$ wherein the cross-sectional area increases ending at the plasma gas discharge orifice 39.

The first section $L_1$ is generally shaped as a cylindrical bore adapted to receive an axial electrode (not shown). The converging section $L_2$ and the diverging section $L_3$ may be configured in a variety of bore configurations, geometrically speaking, such that each section forms one or more "solids of revolution." The "solids of revolution" seen in the prior art are generally defined by combinations of cones and cylinders that have angular intersections. Unlike the prior art configurations, the "solids of revolution" provided for herein can be defined by curves (i.e., continuous smooth functions) other than those that strictly form cylinders or cones, including shapes resulting from curves represented by algebraic functions (e.g., quadratic, rational, root), transcendental functions (exponential, hyperbolic, logarithmic, power, trigonometric), and the like.

Three different embodiments are shown in FIGS. 3-5, wherein like reference numeral designate the same or substantially corresponding parts. As correspondingly shown in these three embodiments of FIGS. 3-5, the first section $L_1$ is generally shaped as a cylindrical bore and adapted to receive an electrode (not shown). The first section $L_1$ transitions at intersection $I_1$ to the converging section $L_2$, which is generally configured as a smoothly converging bore. The configuration of the walls forming the bore defined by the converging section $L_2$ is bounded by one or more continuous joined curves decreasing toward the exit orifice revolved about the central axis 25. Thereafter, the converging section $L_2$ transitions at intersection $I_2$ to the diverging section $L_3$. The intersection between converging section $L_2$ and diverging section $L_3$ forms a throat 34, which serves as the minimum diameter of the central bore 30. The configuration of the walls forming the portion of the central bore 30 defined by the diverging section $L_3$ is bounded by a continuous curve revolved about the central axis 25. As correspondingly shown in these three embodiments of FIGS. 3-5, this continuous curve of diverging section $L_3$ may be a sloped line forming a conical shape or a parabolic curve forming a paraboloid that resembles a trumpet or funnel shape (hereinafter referred to as a parabolic section).

Turning now to the distinctions between the embodiments shown in FIGS. 3-5, the following discussion mainly focuses on different configurations of converging section $L_2$ and intersection $I_1$. In the first embodiment, shown in FIG. 3, a smooth/radial intersection $I_1$ connects the sections with a radius/arc or similar smooth transition or curve rather than a sharp corner as often seen in the prior an. In this manner, sections $L_1$ and $L_2$ share a common tangent direction at the join point $I_1$. The radial intersection $I_1$ transitions into a series of three continuous curves forming sub-sections of $L_2$, namely, $L_{2A}$, $L_{2B}$, and $L_{2C}$. Looking at each of these continuous curves in detail and their corresponding solids of revolution, $L_{2A}$ substantially comprises a radial curve or circular curve that generally resembles an ellipsoid section, $L_{2B}$ substantially comprises a sloped line that generally forms a conical section, and $L_{2C}$ substantially comprises a parabolic curve that generally forms a parabolic section. The intersections between each of these sub-sections of $L_2$, namely, $L_{2A}$, $L_{2B}$, and $L_{2C}$, substantially share a common tangent direction at the intersection point to allow for a smooth transition and avoiding sharp corners or edges.

In a second embodiment shown in FIG. 4, the configuration is essentially the same as that of FIG. 3 except converging section $L_2$ comprises two sub-sections, $L_{2A}$ and $L_{2C}$. A smooth/radial intersection $I_1$ connects sections $L_1$ and $L_2$ with a radius/arc or similar smooth transition or curve rather than a sharp corner so that sections $L_1$ and $L_2$ share a common tangent direction at the join node $I_1$. The radial intersection $I_1$ transitions into a series of two continuous curves forming sub-sections of $L_2$, namely, $L_{2A}$, and $L_{2C}$. Looking at each of these continuous curves in detail and their corresponding solids of revolution, $L_{2A}$ substantially comprises a radial curve or circular curve that generally resembles an ellipsoid section and $L_{2C}$ substantially comprises a parabolic curve that generally forms a parabolic section. The intersections between each of these sub-sections of $L_2$, namely, $L_{2A}$, and $L_{2C}$, substantially share a common tangent direction at the intersection point to allow for a smooth transition and avoiding sharp corners or edges.

In a third embodiment shown in FIG. 5, again the configuration is essentially the same as that of FIG. 3 except the initial intersection $I_1$ is not radiused and sub-section $L_{2A}$ is not provided. In this embodiment, a sharp/angular intersection $I_1$ connects sections $L_1$ and $L_2$. Thereafter, a series of two continuous curves form sub-sections of $L_2$, namely, $L_{2B}$ and $L_{2C}$. Looking at each of these continuous curves in detail and their corresponding solids of revolution, $L_{2B}$ substantially comprises a sloped line that generally forms a conical section and $L_{2C}$ substantially comprises a parabolic curve that generally forms a parabolic section. The intersections between each of these sub-sections of $L_2$, namely, $L_{2B}$ and $L_{2C}$ substantially share a common tangent direction at the intersection point to allow for a smooth transition and avoiding sharp corners or edges.

In each of these embodiments, except where noted otherwise, the walls forming the sections of the central bore 30 and the transitions between the sections are specifically configured to substantially incorporate smooth transitions and avoid sharp corners or edges. This can be accomplished by including radius edges or by connecting the sections with a radius/arc or similar smooth transition or curve. In computer-aided design, this can be accomplished using the "tangent" or "tangent arc" function to connect a line to an arc, circle, parabola, and other similar intersections. Such a feature is available in CAD programs such as SolidWorks, Applicant or ProEngineer. In this manner, at the intersections, the curves share a common tangent relationship or direction at the join point. Because much of the turbulence occurs after the initiation point, a focus is to at least have the radial or smooth edges for the sections and curves located distal to the initiation point generated at a gap between the nozzle body and an electrode disposed within the central bore of the nozzle body.

In addition to the specifically illustrated shapes of the sections in FIGS. 3-5, any number of shapes or functions defining curves that form the bore sections and sub-sections to avoid sharp corners or edges are contemplated herein. By configuring a central bore with these smooth transitions and curves, such a nozzle can achieve cut quality that is equal to or superior to prior art nozzles that do not incorporate smooth transitions or even prior art nozzles that include a secondary flow path within a two-piece nozzle. Without a smooth transition between the cylindrical and conical sections, especially after an initiation point as you approach a throat and discharge orifice, turbulent flow or recirculation zones can occur at these intersections resulting in a decrease in the portion of the plasma jet that is in laminar flow. Through the use of smooth transitions in a central bore, the exit velocity of the plasma jet can be increased over similar designs that do not incorporate smooth transitions. The increased plasma jet velocity can facilitate increased perpendicularity of cut surfaces, sharper corners on the edges of cuts, and smoother or more uniform surface finish of cuts made with a nozzle in accordance with the invention. The net effect being reduced secondary machining of parts cut by a nozzle manufactured in accordance with the present invention.

Moreover, another advantage of the configuration herein is the combined shape of the converging and diverging sections $L_2$ and $L_3$ being generally similar to that of a de Laval style rocket nozzle where the intersection of the converging section $L_2$ and the diverging section $L_3$ comprises a throat where the cross-sectional area is at a minimum and produces a laminar flow stream when optimally sized and a turbulent or choked flow stream when improperly sized. In a typical de Laval style rocket nozzle the length of the diverging section is longer than the converging section of the nozzle. In contrast, the length of converging section $L_2$ is longer than the length of the diverging section $L_3$ in a nozzle made in accordance with the present invention. The specifically configured converging and diverging sections herein increase the velocity of the plasma jet produced by the nozzle through the use of a Venturi effect, similar to the de Laval nozzle, but without the use of a diverging outlet section that is significantly longer than the converging inlet section. In this manner, the configuration herein improves upon the de Laval style plasma torch nozzles of the prior art.

The following examples illustrate specific embodiments and example dimensions of the invention.

Referring to the embodiment of the present invention illustrated in FIG. 3, the following detailed dimensions illustrate a specific example of the invention. In this specific example, the conical section $L_{2B}$ and the central axis 25 forms an angle/slope within a range of 30°-60°. The throat 34 constitutes a minimum inner diameter of the nozzle 20 and is within a range of 0.001905 m (0.075 in) to 0.00254 m (0.100 in). The diverging section $L_3$ can be defined as a conical or parabolic section with an angle/slope between 0°-15° relative to the central axis 25 of the nozzle 20. The curve of the diverging section $L_3$ is connected tangent to the curve of the converging section $L_2$ at the throat 34.

Referring now to the embodiment of the present invention illustrated in FIG. 5, the following detailed dimensions illustrate a specific example of the invention. In this specific example, the conical section $L_{2B}$ forms a fixed angle/slope of 43° relative to the central axis 25, but this angle can be between 30° and 60°. In this case, the throat 34 constitutes a minimum inner diameter of the nozzle 20 and is 0.0020574 m (0.081 in), but can be within a range of 0.001905 m (0.075 in) to 0.00254 m (0.100 in), for a plasma torch that has a plasma gas mass flow rate of substantially 80 L/min. It should be noted that the throat 34 will have to be resized for a plasma torch that uses a different mass flow rate for the plasma gas, such as a plasma torch with a different current rating. The diverging section $L_3$ is defined by a conical section that has an angle/slope of 5° relative to the central axis 25, but can be between 0°-15°. The curve of the diverging section $L_3$ is connected tangent to the curve or the converging section $L_2$ at the throat 34.

Testing has revealed that the exit velocity of nozzle 20 manufactured in accordance with the present invention is preferably kept at or below supersonic to prevent separation of plasma jet, rather Mach number less than or equal to 1. Maintaining an exit velocity between 200 m/s and 343 m/s when compressed air is used as the plasma gas has yielded favorable results, in particular 278 m/s, for nozzle 20 with a throat 34 diameter between 0.001905 m (0.075 in) and 0.00254 m (0.100 in). The pressure and mass flow rate of the plasma gas are accounted for when sizing nozzle 20 in accordance with the invention. Testing has determined that a feed orifice 32 to discharge orifice 39 pressure ratio between 1.40 and 1.15 produces beneficial results. Additional testing with compressed air as the plasma gas has determined that the ratio of exit velocity to throat 34 diameter should be between 1.0287e-5 seconds to 5.998e-6 seconds.

The pressure drop produced by a nozzle 20 manufactured in accordance with the present invention has been found to be within a range of 62.05 kpa (9 psi) and 137.89 kpa (20 psi) depending on the mass flow rate and the geometry of the diverging and converging sections. In one embodiment, the pressure drop was round to be substantially 103.42 kpa (15 psi). The pressure drop in a nozzle 20 designed in accordance with the present invention will be lower than a prior art design that does not nave smoother radial transitions. Additionally, prior art nozzles that have a secondary flow path to reduce turbulence and recirculation zones will inherently have a reduced mass flow rate at the nozzle orifice that translates to a lower exit velocity when compared to a nozzle with a single now path with similar geometries, like the present invention.

The invention claimed is:

1. A nozzle for use with a plasma arc torch, comprising:

a nozzle body having an axial length that extends from a proximal end to a distal end;

a central bore disposed within the nozzle body along a central axis having a gas feed orifice at the proximal end of the nozzle body and a plasma discharge orifice at the distal end of the nozzle body;

wherein the central bore of the nozzle body comprises a counter bore section and a gas flow path section;

wherein the counter bore section of the central bore begins at the proximal end of the nozzle body and extends in an axial direction along the central axis of the nozzle body from the proximal end of the nozzle body to a the gas feed orifice of the nozzle body located at an intersection of the counter bore section of the central bore and the flow path section of the central bore;

wherein the gas flow path section comprises an internal sidewall and a series of internal sections bounded by said internal sidewall, wherein the internal sections maintain geometric continuity of the internal sidewall such that smooth transitions occur between all the internal sections of the central bore with at least one radial intersections between the gas feed orifice and the plasma discharge orifice;

wherein the series of internal sections that maintain geometric continuity of the gas flow path section of the central bore comprise a first section beginning at the gas feed orifice of the nozzle body and transitions to a converging section that transitions at a throat to a diverging section ending at the plasma discharge orifice; and wherein a first radial intersection occurs between the first section and converging section of the gas flow path section of the central bore;

wherein a second radial intersection occurs between the converging section and diverging section of the gas flow path section of the central bore.

2. The nozzle of claim 1, wherein the first section that maintains geometric continuity of the gas flow path section of the central bore of the nozzle comprises a cylindrical geometry about the central axis of the nozzle body adapted to receive a cylindrical electrode along the central axis of the nozzle body in a plasma cutting torch assembly creating a gas flow path between an inner diameter of the nozzle body and an outer diameter of the cylindrical electrode.

3. The nozzle of claim 2, wherein the first section comprises a uniform cylindrical diameter and proceeds in the axial direction for at least half of the axial length of the nozzle body.

4. The nozzle of claim 1, wherein the diverging section is configured as a bore bounded by a wall, wherein the shape of the bore comprises a region bounded by a curve and revolved about the central axis, wherein the curve is continuously increasing in the axial direction toward the plasma discharge orifice.

5. The nozzle of claim 4, wherein the curve comprises one or more curve sections defined by a continuous smooth mathematical function, wherein intersections of the curve sections along the axial length of the curve are curved.

6. The nozzle of claim 1, wherein the diverging section is conical or parabolic and has an increasing slope between an axial location of the throat and the plasma discharge orifice creating an exit angle between 0°-15° relative to the central axis and an inner diameter of the diverging section.

7. The nozzle of claim 1, wherein the converging section is configured as a bore bounded by a wall, wherein the shape of the bore comprises a region bounded by a curve and revolved about the central axis, wherein a diameter of the curve is continuously decreasing along the axial direction as the curve proceeds toward the plasma discharge orifice.

8. The nozzle of claim 7, wherein the curve comprises one or more curve sections defined by a continuous smooth mathematical function that does not include sharp corners or edges at the radial intersections along the axial length of the curve.

9. The nozzle of claim 1, wherein at least a portion of the converging section is conical or parabolic and has a decreasing slope between the first section and the throat creating a converging angle between 30°-60° relative to the central axis and an inner diameter of the converging section.

10. The nozzle of claim 7, wherein the converging section comprises a combination of one or more of an ellipsoid section, a conical section, and a parabolic section.

11. The nozzle of claim 10, wherein transitions between the internal sections of the gas flow path of the nozzle are curved and do not include sharp corners or edges at an intersection point between the sections which share a common tangent relationship at the intersection point.

12. The nozzle of claim 1, wherein the throat that connects the converging section and the diverging section is curved and does not include sharp corners or edges at an intersection point between the internal sections of the gas flow path of the nozzle which shares a common tangent relationship with converging section and diverging section.

13. The nozzle of claim 1, wherein the throat comprises a minimum diameter for the central bore.

14. The nozzle of claim 1, wherein at least one of the one or more radial intersections is located distal to an initiation point generated at a gap between the nozzle body and an electrode disposed within the central bore of the nozzle body.

15. The nozzle of claim 1, wherein the nozzle is adapted to increase the velocity of a plasma gas to at least 250 m/s by reducing the amount of turbulence and the recirculation zones.

16. The nozzle of claim 1, wherein the nozzle is adapted to maintain a plasma gas velocity at the throat within a range of 200 m/s to 343 m/s.

17. The nozzle of claim 1, wherein the nozzle is adapted to maintain a plasma gas velocity at the throat to substantially 278 m/s.

18. The nozzle of claim 1, wherein the nozzle is configured such that a ratio of the throat diameter to the exit velocity is substantially 7.40e-6 seconds.

19. The nozzle of claim 1, wherein the nozzle is configured such that a ratio of the throat diameter to the exit velocity is within a range of 1.0287e-5 seconds to 5.998e-6 seconds.

20. The nozzle of claim 1, wherein the nozzle is configured such that the pressure ratio of the nozzle intake pressure to nozzle exhaust pressure is 1.16941.

21. The nozzle of claim 1, wherein the nozzle is configured such that the pressure ratio of the nozzle intake pressure to nozzle exhaust pressure is within a range of 1.1 to 1.5.

22. A nozzle for use with a plasma arc torch, comprising:

a nozzle body having an axial length that extends from a proximal end to a distal end;

a central bore disposed within the nozzle body along a central axis having a gas feed orifice at the proximal end of the nozzle body and a plasma discharge orifice at the distal end of the nozzle body;

wherein the central bore of the nozzle body comprises a counter bore section and a gas flow path section;

wherein the counter bore section of the central bore begins at the proximal end of the nozzle body and extends in an axial direction along the central axis of the nozzle body from the proximal end of the nozzle body to a the gas feed orifice of the nozzle body located at an intersection of the counter bore section of the central bore and the gas flow path section of the central bore;

wherein the gas flow path section comprises an internal sidewall and a series of internal sections bounded by said internal sidewall, wherein the internal sections maintain geometric continuity of the internal sidewall such that smooth transitions occur between all the internal sections of the central bore with one or more radial intersections between the gas feed orifice and the plasma discharge orifice;

wherein the series of internal sections that maintain geometric continuity of the gas flow path section of the central bore comprise a first section beginning at the gas feed orifice of the nozzle body and transitions to a converging section that transitions at a throat to a diverging section ending at the plasma discharge orifice; and wherein a first radial intersections occur between the first section and converging section of the gas flow path section of the central bore;

wherein a second radial intersections occur between the converging section and diverging section of the gas flow path section of the central bore;

wherein an axial length of the converging section along the central axis of the nozzle body is longer than an axial length of the diverging section along the central axis of the nozzle body and the axial length of the first section is longer than the axial length of the converging or diverging sections along the central axis of the nozzle body.

23. The nozzle of claim 22, wherein the first section that maintains geometric continuity of the gas flow path section of the central bore of the nozzle comprises a cylindrical geometry about the central axis of the nozzle body adapted to receive a cylindrical electrode along the central axis of the nozzle body in a plasma cutting torch assembly creating a gas flow path between an inner diameter of the nozzle body and an outer diameter of the cylindrical electrode.

24. The nozzle of claim 23, wherein the first section comprises a uniform cylindrical diameter and proceeds in the axial direction for at least half of the axial length of the nozzle body.

25. The nozzle of claim 22, wherein the diverging section is configured as a bore bounded by a wall, wherein the shape of the bore comprises a region bounded by a curve and revolved about the central axis, wherein the curve is continuously increasing in the axial direction toward the plasma discharge orifice.

26. The nozzle of claim 25, wherein the curve comprises one or more curve sections defined by a continuous smooth mathematical function, wherein intersections of the curve sections along the axial length of the curve are curved.

27. The nozzle of claim 22, wherein the diverging section is conical or parabolic and has an increasing slope between an axial location of the throat and the plasma discharge orifice creating an exit angle between 0°-15° relative to the central axis and an inner diameter of the diverging section.

28. The nozzle of claim 22, wherein the converging section is configured as a bore bounded by a wall, wherein the shape of the bore comprises a region bounded by a curve and revolved about the central axis, wherein a diameter of the curve is continuously decreasing along the axial direction as the curve proceeds toward the plasma discharge orifice.

29. The nozzle of claim 28, wherein the curve comprises one or more curve sections defined by a continuous smooth mathematical function that does not include sharp corners or edges at the radial intersections along the axial length of the curve.

30. The nozzle of claim 22, wherein at least a portion of the converging section is conical or parabolic and has a decreasing slope between the first section and the throat creating a converging angle between 30°-60° relative to the central axis and an inner diameter of the converging section.

31. The nozzle of claim 28, wherein the converging section comprises a combination of one or more of an ellipsoid section, a conical section, and a parabolic section.

32. The nozzle of claim 31, wherein transitions between the internal sections of the gas flow path of the nozzle are curved and do not include sharp corners or edges at an intersection point between the sections which share a common tangent relationship at the intersection point.

33. The nozzle of claim 22, wherein the throat that connects the converging section and the diverging section is curved and does not include sharp corners or edges at an intersection point between the internal sections of the gas flow path of the nozzle which shares a common tangent relationship with converging section and diverging section.

34. The nozzle of claim 22, wherein the throat comprises a minimum diameter for the central bore.

35. The nozzle of claim 22, wherein at least one of the one or more radial intersections is located distal to an initiation point generated at a gap between the nozzle body and an electrode disposed within the central bore of the nozzle body.

36. The nozzle of claim 22, wherein the nozzle has only one flow path.

37. The nozzle of claim 1, wherein the nozzle has only one flow path.

38. The nozzle of claim 22, wherein the nozzle is manufactured from a single piece of material.

39. The nozzle of claim 1, wherein the nozzle is manufactured from a single piece of material.

* * * * *